United States Patent [19]

Wright, III

[11] Patent Number: 4,756,511

[45] Date of Patent: Jul. 12, 1988

[54] SILT FENCE

[75] Inventor: George H. Wright, III, New Castle, Del.

[73] Assignee: Certified Stake Co., Inc., New Castle, Del.

[21] Appl. No.: 42,971

[22] Filed: Apr. 27, 1987

[51] Int. Cl.[4] ..... E04H 17/00

[52] U.S. Cl. ..... 256/12.5; 256/52

[58] Field of Search ..... 256/12.5, 52

[56] References Cited

U.S. PATENT DOCUMENTS

| | | | |
|---|---|---|---|
| 573,512 | 12/1896 | Hearnshaw | 256/52 X |
| 1,099,403 | 6/1914 | Snoke | 256/52 |
| 1,420,140 | 6/1922 | Peleskey | 256/52 |
| 2,134,624 | 10/1938 | Royall | 256/12.5 X |
| 2,872,161 | 2/1959 | Olson | 256/12.5 X |
| 4,191,361 | 3/1980 | Jensen | 256/12.5 |

*Primary Examiner*—Andrew V. Kundrat

*Attorney, Agent, or Firm*—Connolly & Hutz

[57] ABSTRACT

A silt fence comprises a plurality of spaced stakes having pointed ends for being anchored to the ground. A fabric is secured to and spans the stakes to create the fence. The fabric is secured to the stakes by means of mounting strips positioned against each stake with the fabric therebetween. Fasteners extend through the strips and fabric and into the stakes.

14 Claims, 1 Drawing Sheet

SILT FENCE

BACKGROUND OF THE INVENTION

The present invention relates to silt fences which are used to prevent erosion, particularly erosion of on site soil during a construction period. Such fences conventionally include stakes having pointed ends mounted to the ground with a fabric web secured to the stakes. In practice, however, it has been found that the conventional means of securement is quite unsatisfactory, resulting in the web being torn from the strakes. For example, where such fasteners as staples are used, the staples tend to tear through the fabric web when exposed to environmental conditions, such as high winds, snow drifts and the like. It would, therefore, be desirable to provide a silt fence which could withstand such environmental conditions and provide a silt fence capable of functioning in its intended manner over long periods of time.

SUMMARY OF INVENTION

An object of this invention is to provide a silt fence which includes means for securely mounting the web to the stakes.

A further object of this invention is to provide such a silt fence wherein the web may be mounted to the stakes in a simple and economical manner.

In accordance with this invention each stake is provided with a mounting strip, which is secured against the stake with the fabric therebetween. The mounting strip makes contact with the fabric over an extended width of the fabric so that there is a surface securement instead of simply spaced point securements as in the conventional manner. The mounting strips and fabric may be secured to the stakes in any suitable manner, such as by conventional fasteners, including staples, nails and the like.

THE DRAWINGS

DETAILED DESCRIPTION

Figure 1:
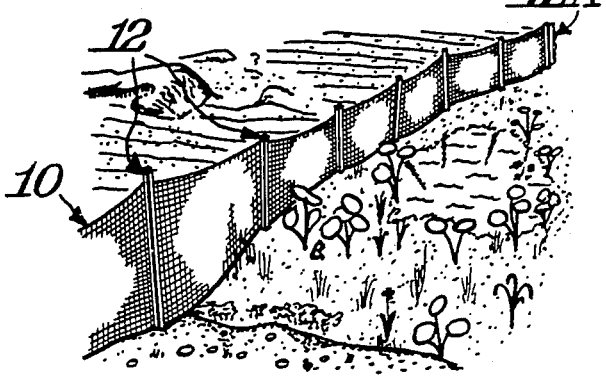
FIG. 1 is a perspective view showing a silt fence in accordance with this invention.
Figure 4:
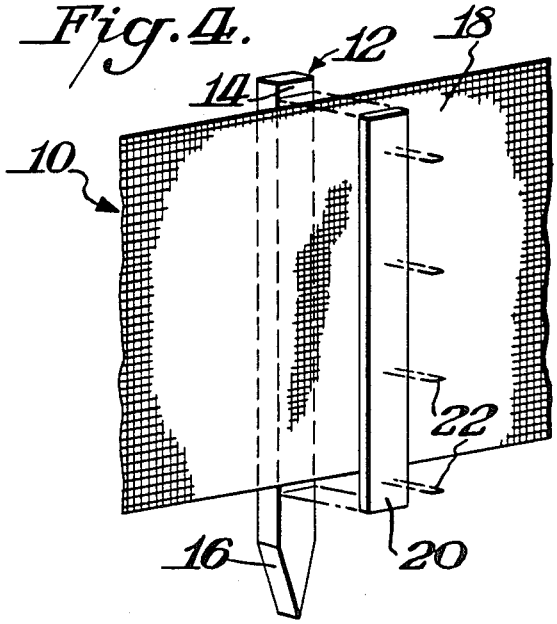
FIG. 4 is an exploded view of a portion of the silt fence shown in FIGS. 1-3.

FIGS. 1-4 show a silt fence 10 in accordance with this invention. As shown therein, silt fence 10 includes a plurality of spaced stakes 12 each of which comprises a main body portion 14 which terminates in a pointed end 16 so that the end 16 may be driven into the ground for anchoring the stakes in a vertical or upright position. Stakes 12 may be of any suitable size, shape and material and may be of conventional form wherein the stakes are wooden stakes, such as oak, of rectangular cross-section one inch thick and one and five-eighths inches thick and one and five-eighths inches wide. The pointed end may be of any suitable dimension, such as three and a half inches long.

As also shown in FIGS. 1-4, fence 10 includes a web 18 of any suitable construction, such as conventionally used for silt fences. Web 18, may for example, be a woven fabric made of a suitable plastic material and is of a length sufficient to span the various sets of spaced stakes 12. Web 18 would be of a width or vertical dimension slightly smaller than the length of body portion 14 of stakes 12. The combination of stakes and web could accordingly take the form conventionally used in the prior art.

FIGS. 1-4 illustrate the inclusion of mounting means for securely mounting the web 18 to the stakes 12 in a manner superior to that used in the prior art. The mounting means includes the utilization of a mounting strip 20 provided for each stake 12. Strip 20 may be of any suitable form and in the preferred practice of this invention, strip 20 is simply a furring strip made of wood, such as oak, and of rectangular cross-section being for example about one inch wide and about three-sixteenths inches thick. The length of strips 20 must be such that at least a substantial portion of web 18 is sandwiched between strip 20 and its respective stake 12. In the preferred practice of this invention strips 20 would be of a length corresponding to the width of web 18. If desired, however, strips 20 may be longer than web 18 so that a portion of each strip extends above and below web 18. The invention, however, may even be practiced with strips 20 of a lesser length than the width of fabric web 18. Although such is not as preferred, since the corners of strips 20 might cause tears to result in web 18. Where smaller strips are used, the upper edge of such strip should be located generally at the upper edge of the web.

Strips 20 and web 18 are secured to stakes 12 in any suitable manner. FIGS. 1-4, for example, show the conventional means of utilizing spaced staples 22 of U-shape as the fasteners which extend completely through strip 20 and fabric 18 and having their points or free ends embedded in stakes 12. It is to be understood that any other suitable fasteners such as nails, screws, tacks, etc. may be used in accordance with this invention.

Figure 3:
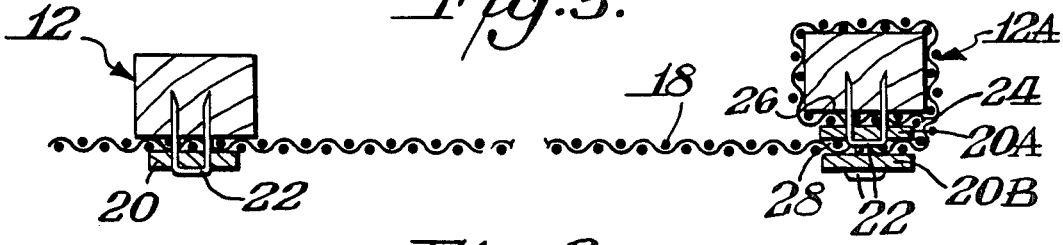
FIG. 3 is a cross-sectional view taken through FIG. 2 along the line 3—3.
Figure 2:
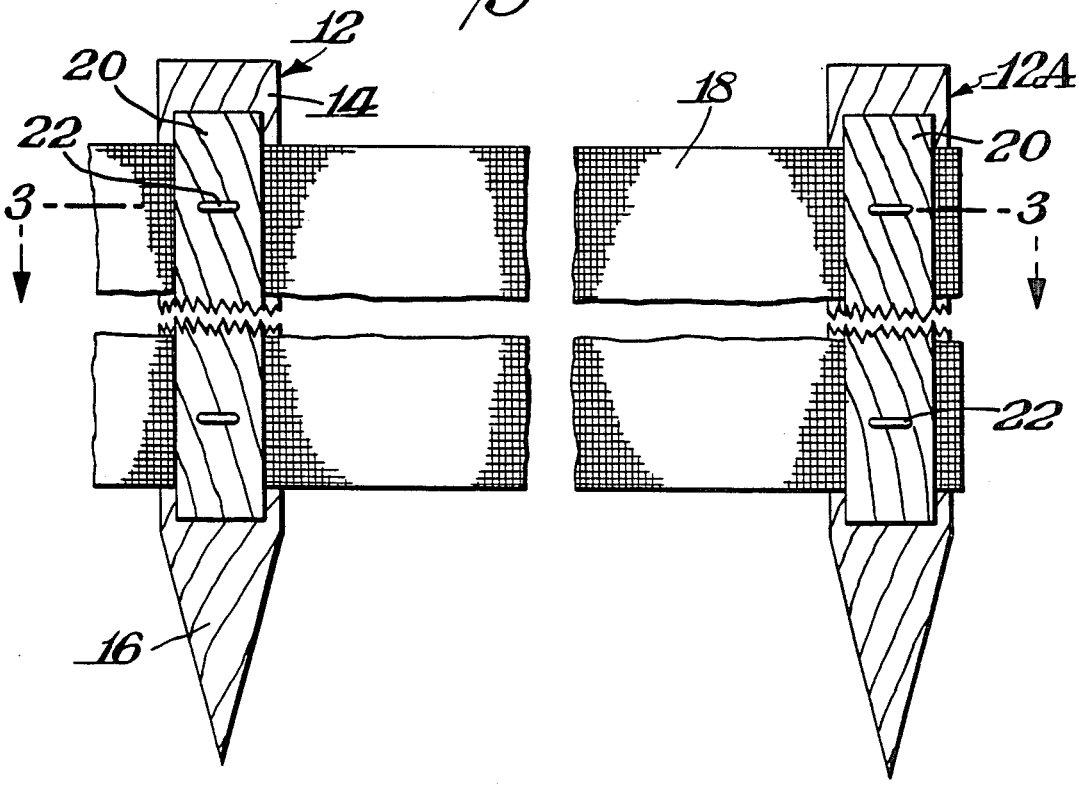
FIG. 2 is a side elevation view partly broken away of a portion of the silt fence shown in FIG. 1.

FIG. 3 shows the manner of mounting web 18 to the end most stake 12A. As shown therein the free end 24 of fabric web 18 is disposed against flat side 26 of end stake 12A. Web 18 is then wrapped around stake 12A. Prior to such wrapping, however, a strip 20A is disposed against end 24 of web 18. When web 18 is wrapped around end stake 12A a complete revolution the web is then wrapped around strip 20A to form a second layer 28 outwardly beyond strip 20A. A second strip 20B is disposed against web layer 28. Fastener 22 is then secured through both strips 20A and 20B as well as both web layers 24 and 28 with the pointed ends of fastener 22 embedded in corner stake 12A.

Although the drawings illustrate the stakes and strips to be of rectangular shape the invention may be practiced with variations thereof. For example, round stakes may be used in which case it would be preferred to have the strips of arcuate shape conforming to the arcuate surface of the stakes which the strips would contact. This is not as desirable, however, since the flat surfaces imparted by the rectangular stakes and strips provides a smoother spanning of the stakes by web 18 which in turn lends itself to a more secure mounting of web 18. It is also be be understood that while the preferred practice of this invention utilizes a mounting strip for each stake, the invention may be practiced by omitting a mounting strip for certain of the stakes should such be considered more expedient.

The invention accordingly provides a silt fence wherein the fabric web is securely mounted to the stakes by a mounting strip which makes a surface contact between the web and the stake so that in effect the mounting is by means of an area of substantial dimension corresponding to the dimension of the strips rather than having the mounting being solely by fasteners which make only point contact at isolated points of the fabric. Such point contacts as used in conventional practices tend to permit the fabric web to be easily torn and thus result in a poorly mounted web which of course defeats the purpose of the silt fence.

What is claimed:

1. A silt fence for preventing soil erosion at construction sites and the like comprising a plurality of spaced wooden stakes of rectangular cross section, each of said stakes comprising a main body portion having a pointed end to provide anchoring means at its lower end, a flexible woven fabric web disposed against and spanning said stakes, said anchoring means extending below said web whereby said web remains above ground level when said fence is mounted in a vertical position, a plurality of web mounting flat strips of rectangular cross section thinner and narrower than said stakes, each of said strips being disposed against one of said stakes with said web sandwiched therebetween, and fasteners extending piercing through each of said strips and through said web and embedded into its respective stake.

2. The silt fence of claim 1 wherein said web is completely wrapped around the endmost one of said stakes.

3. The silt fence of claim 1 wherein a plurality of said fasteners extends through each of said strips.

4. The silt fence of claim 3 wherein each of said stakes includes a flat side, and each of said strips having a flat side disposed against said flat side of a respective stake.

5. The silt fence of claim 1 wherein each of said strips is of a length substantially equal to the width of said web.

6. The silt fence of claim 1 wherein each of said strips is of a length greater than the width of said web, and each of said strips extending beyond said web.

7. The silt fence of claim 1 wherein said fasteners are staples.

8. A silt fence for preventing soil erosion as construction sites and the like comprising a plurality of spaced stakes, each of said stakes comprising a main body portion having anchoring means at its lower end, a fabric web disposed against and spanning said stakes, said anchoring means extending below said web whereby said web remains above ground level when said fence is mounted in a vertical position, a plurality of web mounting strips, each of said strips being disposed against one of said stakes with said web sandwiched therebetween, fasteners extending through each of said strips and through said web and into its respective stakes said web being completely wrapped around the endmost one of said stakes, a pair of said strips being secured to said endmost stake.

9. The silt fence of claim 8 wherein said web is wrapped around said endmost stake in a double layer at one side of said endmost stake, said pair of strips being disposed on the same side of said endmost stake, one layer of said web being between said endmost stake and one of said strips, and the other layer of said web being between said pair of strips.

10. The silt fence of claim 9 wherein a plurality of said fasteners extends through each of said strips.

11. The silt fence of claim 10 wherein each of said stakes includes a flat side, and each of said strips having a flat side disposed against said flat side of a respective stake.

12. The silt fence of claim 11 wherein each of said strips is of a length substantially equal to the width of said web.

13. The silt fence of claim 11 wherein each of said strips is of a length greater than the width of said web, and each of said strips extending beyond said web.

14. The silt fence of claim 11 wherein each of said stakes is a wooden stake of rectangular cross section, and anchoring means being a pointed end at the lower end of each stake, each of said strips being a flat wooden strip of rectangular cross section thinner and narrower than each of said stakes, one of said strips being provided for each of said stakes, and said fasteners being staples.

* * * * *